US008677980B1

(12) United States Patent
Mucciacciaro

(10) Patent No.: US 8,677,980 B1
(45) Date of Patent: Mar. 25, 2014

(54) FUEL COMBINED WITH CARBON DIOXIDE IN ELONGATE CHAMBER

(71) Applicant: Domenic Mucciacciaro, Boca Raton, FL (US)

(72) Inventor: Domenic Mucciacciaro, Boca Raton, FL (US)

( * ) Notice: Subject to any disclaimer, the term of this patent is extended or adjusted under 35 U.S.C. 154(b) by 0 days.

(21) Appl. No.: 13/986,687

(22) Filed: May 24, 2013

(51) Int. Cl.

| | |
|---|---|
| ***F02B 43/00*** | (2006.01) |
| ***F02B 47/00*** | (2006.01) |
| ***F02M 25/00*** | (2006.01) |
| ***F02M 17/22*** | (2006.01) |

(52) U.S. Cl.
USPC ..... 123/527; 123/1 A; 123/525

(58) Field of Classification Search
USPC ..... 123/1 A, 27 GE, 522, 525, 526, 527, 123/531, 575
See application file for complete search history.

(56) References Cited

U.S. PATENT DOCUMENTS

| | | | | |
|---|---|---|---|---|
| 7,011,048 | B2 | 3/2006 | Gurin | |
| 7,406,955 | B1 | 8/2008 | Gachik | |
| 7,523,747 | B2 | 4/2009 | Gachik | |
| 8,028,681 | B1 * | 10/2011 | Pifer | 123/522 |
| 8,037,849 | B1 | 10/2011 | Staroselsky | |
| 8,464,694 | B2 * | 6/2013 | Gurin et al. | 123/525 |

* cited by examiner

*Primary Examiner* — Stephen K Cronin
*Assistant Examiner* — Sizo Vilakazi
(74) *Attorney, Agent, or Firm* — Alvin S. Blum

(57) ABSTRACT

A fuel conditioning system is applied to common rail direct injection or unit injector diesel engines. A liquid fuel is conditioned with gas for combustion in the combustion chambers. The system includes an elongate conditioning vessel, at least one fuel dispensing inlet, at least one carbon dioxide inlet port, and at least one conditioned fuel outlet port on the vessel. Carbon dioxide and diesel fuel are fed into the inlet portion of the vessel. The mixture travels a path of at least ten feet in the vessel to the outlet portion to cause the carbon dioxide gas to dissolve in the liquid fuel for forming a liquid/gas fuel solution. At least one high-pressure fuel pump feeds the liquid fuel/gas solution into fuel injectors.

11 Claims, 4 Drawing Sheets

FUEL COMBINED WITH CARBON DIOXIDE IN ELONGATE CHAMBER

This application claims the benefit of provisional patent application Ser. No. 61/689,195 filed Jun. 1, 1012, incorporated herein by reference in its entirety.

BACKGROUND OF THE INVENTION

The present invention relates to a field of liquid fuel combustion and, more particularly to delivering to a high-pressure fuel pump (or pumps) a conditioned fuel in the form of a solution in said fuel of such gases as $CO_2$ or air or a mixture of gases with a purpose to achieve a high degree of a fuel dispersion in a combustion chamber of a reciprocating or gas turbine engine, or any other device having a combustion chamber.

It is common knowledge that the dispersion of a liquid fuel within a combustion chamber results in a highly developed active surface of this liquid fuel which allows the fuel to burn fuel more efficiently. The small size of the combustion chamber in a reciprocating engine, for example, may result in the partial deposition of the injected fuel on the piston and combustion chamber walls creating a liquid film on them. This part of fuel can not be burnt completely and may be lost in the exhaust. Uneven distribution of the liquid fuel particles over a volume of the combustion chamber causes a delay in flame propagation, lowering the efficiency of the combustion process, thereby delivering less power. High dispersion of the fuel would avoid these problems. Completely burned fuel delivers more power.

There are different ways to provide dispersion of the liquid fuel, for instance with the help of electronically controlled fuel injectors fed by high-pressure fuel pump or electronically controlled direct injection units, each of them comprising electronically controlled fuel injector and dedicated high-pressure fuel pump. Latest efforts in the area of the fuel direct injection system design by the most prominent automotive engine builders have resulted in the development of very high pressure injection systems—up to 2400 bar. This level of pressure is providing for very fine dispersion of fuel, thus ensuring a significantly improved efficiency of the internal combustion engine. But even those systems are not free from above mentioned shortcomings.

There are known attempts to disperse fuel by dissolving some gas, for instance air or $CO_2$ or a mixture of gases in the liquid fuel at high pressure and subsequently injecting this solution into the combustion chamber. Dissolved gas is getting violently released from the solution if injected into the combustion chamber where pressure is lower than in the injected solution, providing for very fine and uniform dispersion of the liquid fuel.

Reference is had, in this context, to prior art patents, such as, for instance U.S. Pat. Nos. 7,406,955; 7,011,048; 7,523,747; 7,950,370. Those patents describe devices and methods that provide for the implementation of the described effect. The solution of a gas in a liquid is enhanced as the temperature is reduced. By introducing the gas at a low temperature or lowering the temperature of the liquid fuel at the time of introduction of the gas, solution of the gas in the liquid is enhanced.

BRIEF SUMMARY OF THE INVENTION

It is accordingly an object of this invention to provide a method and apparatus which provides for further improvement in the amount of gas dissolved in the fuel for a given size chamber. With the above and other objects in view there is provided, in accordance with the invention, an internal combustion engine with a common rail direct injection fuel supply system or with a unit injector fuel supply system, comprising: an elongate fuel conditioning vessel, at least one fuel inlet port mounted at a first end for discharging fuel into said fuel conditioning vessel; a low-pressure fuel pump and a liquid fuel supply line fluidically connecting an outlet port of the low-pressure fuel pump to the fuel inlet port of the fuel conditioning vessel; at least one gas inlet port for feeding carbon dioxide as a liquid or gas into said fuel conditioning vessel; a carbon dioxide source and a line fluidically connecting an outlet port of the carbon dioxide source with the gas inlet port of the fuel conditioning vessel, whereby the carbon dioxide is dissolved in the liquid fuel for forming a fuel/carbon dioxide solution; and a direct injection unit fuel supply system for feeding conditioned fuel to fuel injectors at a high pressure $P_3$ exceeding a pressure $P_4$ present in the combustion chamber of an internal combustion engine at the moment of injection; and a liquid fuel supply line fluidically connecting an outlet port of the fuel conditioning vessel to inlet ports of individual high pressure pumps at the fuel injectors;

or a high-pressure fuel pump for raising pressure to a high level $P_3$ exceeding a pressure $P_4$ present in the combustion chamber of internal combustion engine at the moment of injection and a liquid/carbon dioxide fuel solution supply line fluidically connecting an outlet port of the fuel conditioning vessel to an inlet port of a high-pressure fuel pump; and a common rail and high-pressure liquid/gas fuel solution supply line fluidically connecting an outlet port of the high-pressure fuel pump to an inlet port of the common rail; and fuel injectors for injecting the fuel solution at a high pressure $P_3$ exceeding a pressure $P_4$ present in the combustion chamber of the internal combustion engine at the moment of injection into said combustion chamber and high-pressure liquid/gas fuel solution supply lines fluidically connecting multiple outlet ports of the common rail to inlet ports of the fuel injectors.

With the above and other objects in view, there is also provided, in accordance with the invention, a method of conditioning fuel and supplying conditioned fuel to a combustion process. The method comprises:

providing an elongate vessel for fuel conditioning, the vessel having a housing, at least one fuel inlet port, a carbon dioxide inlet port, a conditioned fuel outlet port;

feeding liquid fuel into the vessel, and setting a volume of fuel flow through the inlet port sufficient for filling the vessel at the rate not lower than a rate of the fuel consumption by a combustion chamber;

feeding carbon dioxide into the vessel through the carbon dioxide inlet during the process of fuel conditioning in the vessel and feeding conditioned fuel into a high-pressure fuel pump and further into the combustion chamber; to provide an extended path for the fuel and carbon dioxide for enhanced absorption of carbon dioxide in the fuel. Although the invention is illustrated and described herein as embodied in method and system for liquid fuel conditioning, it is nevertheless not intended to be limited to the details shown, since various modifications and structural changes may be made therein without departing from the spirit of the invention and within the scope and range of equivalents of the claims. The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
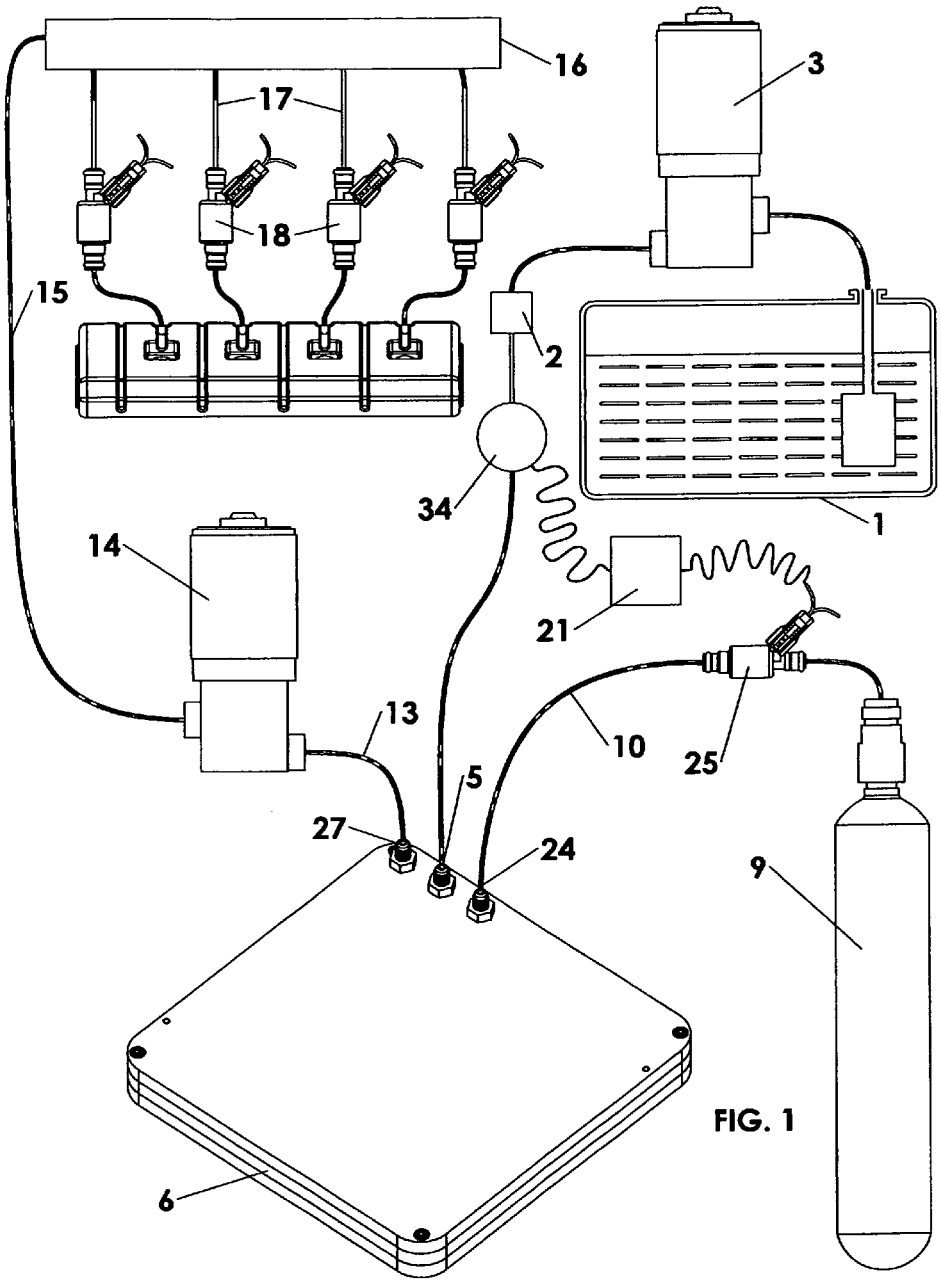
FIG. 1 is a diagrammatic view of the fuel conditioning system for the internal combustion engine with common rail injection fuel supply system.

Referring now to FIG. 1 in detail, the system consists of a fuel tank 1, a fuel filter 2, and a low-pressure fuel pump 3 for delivering liquid fuel from the fuel tank 1 to the fuel inlet 5 of the fuel conditioning vessel 6. A source of liquid carbon dioxide in a siphon tube tank 9 is fluidically connected by the line 10 to the carbon dioxide inlet 24 of the vessel 6 through metering valve 25. A flow meter 34 in the fuel line measures fuel consumption. Valve 25 regulates the amount of carbon dioxide admitted to the conditioning vessel relative to the amount of fuel, the valve being controlled by the flow meter 34 through electronic control 21. A 0.375 inch tubular passage is arranged in two interconnected spirals with a total length of 28 feet in a compact rigid housing whose dimensions do not exceed 18 inches. The elongate path for the mixture results in achieving a significant amount of gas being dissolved in the fuel. An outlet port 27 located at a terminal end of the elongate fuel conditioning vessel 6 is fluidically connected by a line 13 to the inlet port of a high-pressure fuel pump 14. An outlet port of the high-pressure fuel pump 14 is fluidically connected by a line 15 to a common rail 16, which is fluidically connected by lines 17 to the fuel injectors 18 of the internal combustion engine (not shown). Prepared liquid/gas fuel solution is delivered to the high-pressure fuel pump 14 by the line 13, where it is being compressed to the pressure $P_3$ exceeding a pressure in the combustion chamber $P_4$ of an internal combustion engine and is further delivered by high-pressure fuel line 15 to the common rail 16. Electronically controlled injectors 18 fluidically connected with common rail 16 by individual high-pressure lines 17 inject precise portions of the liquid/gas fuel solution at precise time in the combustion chamber of the internal combustion engine. Since the pressure in the injected liquid/gas fuel solution is higher than the pressure in the combustion chamber of the internal combustion engine, dissolved in the liquid/gas fuel solution gas violently escapes from the liquid, breaking it to very small liquid fuel particles, providing for particles even distribution over the volume of the combustion chamber and for the speedy propagation of the burning front. Because of the very small size of the liquid fuel particles, they are burning before said particles can reach combustion chamber walls and the bottom of the piston of the internal combustion engine where otherwise said particles could have created cold film on the surfaces. Faster and more efficiently burnt fuel delivers more energy, so it takes less fuel to produce the same amount of power.

Figure 2:
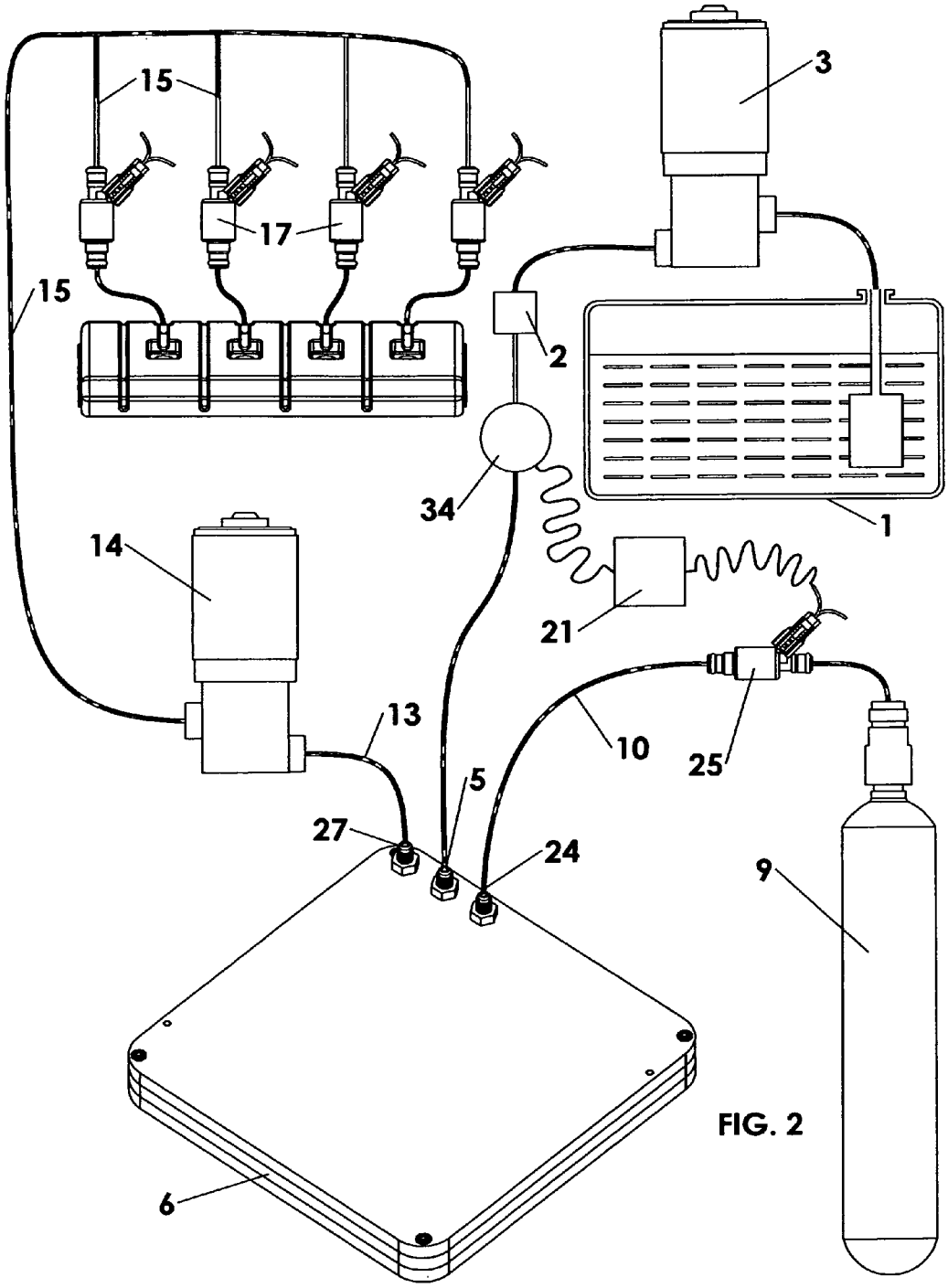
FIG. 2 is a diagrammatic view of the fuel conditioning system for the internal combustion engine with a unit injector fuel supply system.

In another embodiment, referring now to FIG. 2 in detail, the system consists of a fuel tank 1, a fuel filter 2, and a low-pressure fuel pump 3 for delivering liquid fuel from the fuel tank 1 to the fuel inlet 5 of the fuel conditioning vessel 6. A source of carbon dioxide gas in a tank 9 is fluidically connected by the line 10 to the carbon dioxide inlet 24 of the vessel 6 through metering valve 25. The vessel 6 may be provided with spray nozzles and vibration to finely disperse the incoming carbon dioxide gas in the liquid fuel to enhance solution of the gas in the fuel. The 0.375 inch tubular passage is arranged in two interconnected spirals with a total length of 28 feet in a compact rigid housing. The elongate path for the mixture results in achieving a significant amount of gas being dissolved in the fuel. An outlet port 27 located at a terminal end of the elongate fuel conditioning vessel 6 is fluidically connected by a line 13 to the inlet port of a high-pressure fuel pump 14. An outlet port of the high-pressure fuel pump 14 is fluidically connected by lines 15 to the fuel injectors 18 of the internal combustion engine (not shown). Prepared liquid/gas fuel solution is delivered to the high-pressure fuel pump 14 by the line 13, where it is being compressed to the pressure $P_3$ exceeding a pressure in the combustion chamber $P_4$ of an internal combustion engine and is further delivered by high-pressure fuel lines 15 to electronically controlled injectors 18 to inject precise portions of the liquid/gas fuel solution at precise time in the combustion chamber of the internal combustion engine. Since the pressure in the injected liquid/gas fuel solution is higher than the pressure in the combustion chamber of the internal combustion engine, dissolved in the liquid/gas fuel solution gas violently escapes from the liquid, breaking it to very small liquid fuel particles, providing for particles even distribution over the volume of the combustion chamber and for the speedy propagation of the burning front. Because of the very small size of the liquid fuel particles, they are burning before said particles can reach combustion chamber walls and the bottom of the piston of the internal combustion engine where otherwise said particles could have created cold film on the surfaces. Faster and more efficiently burnt fuel delivers more energy, so it takes less fuel to produce the same amount of power.

Figure 3:
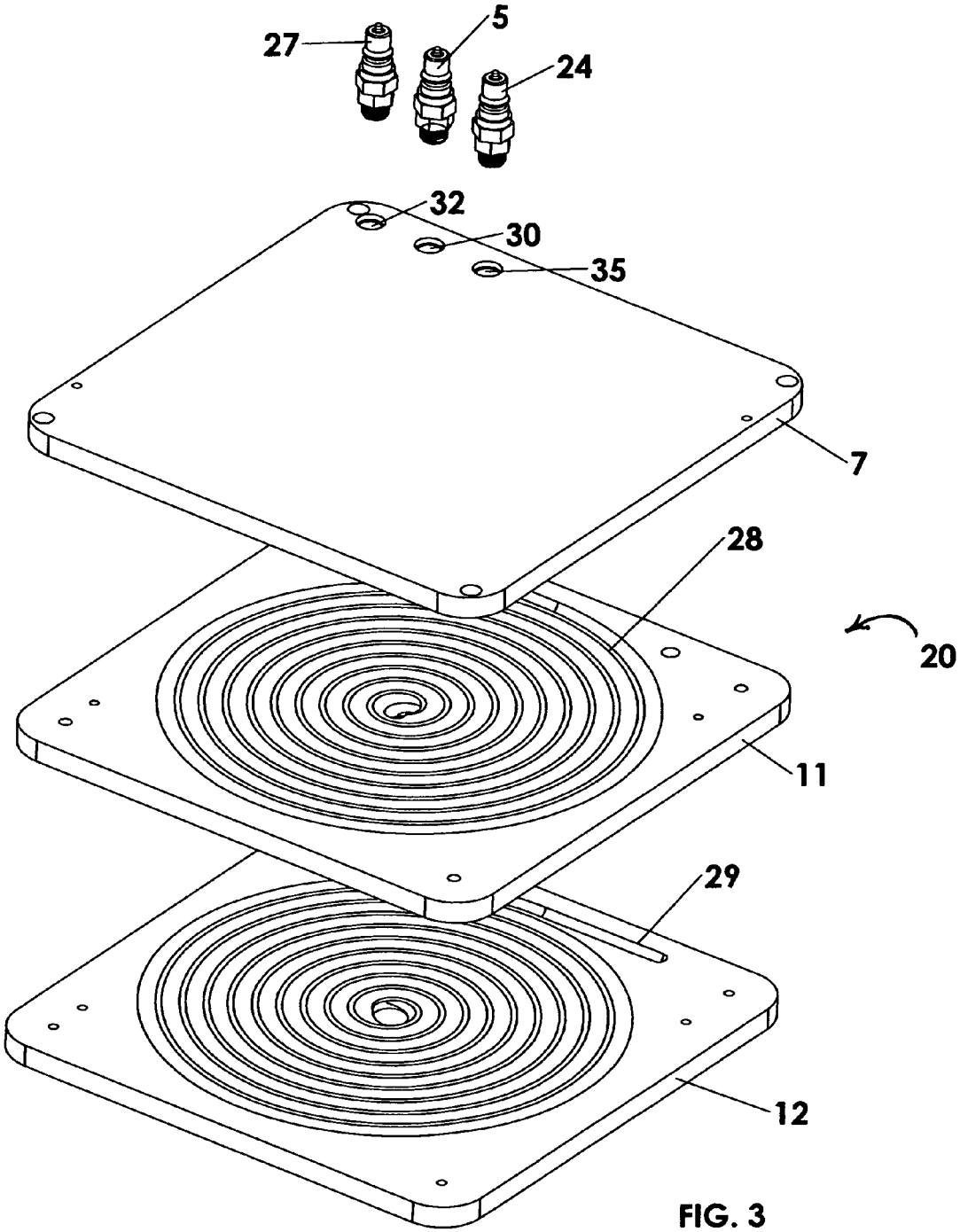
FIG. 3 is a perspective exploded view of the conditioning vessel.
Figure 4:
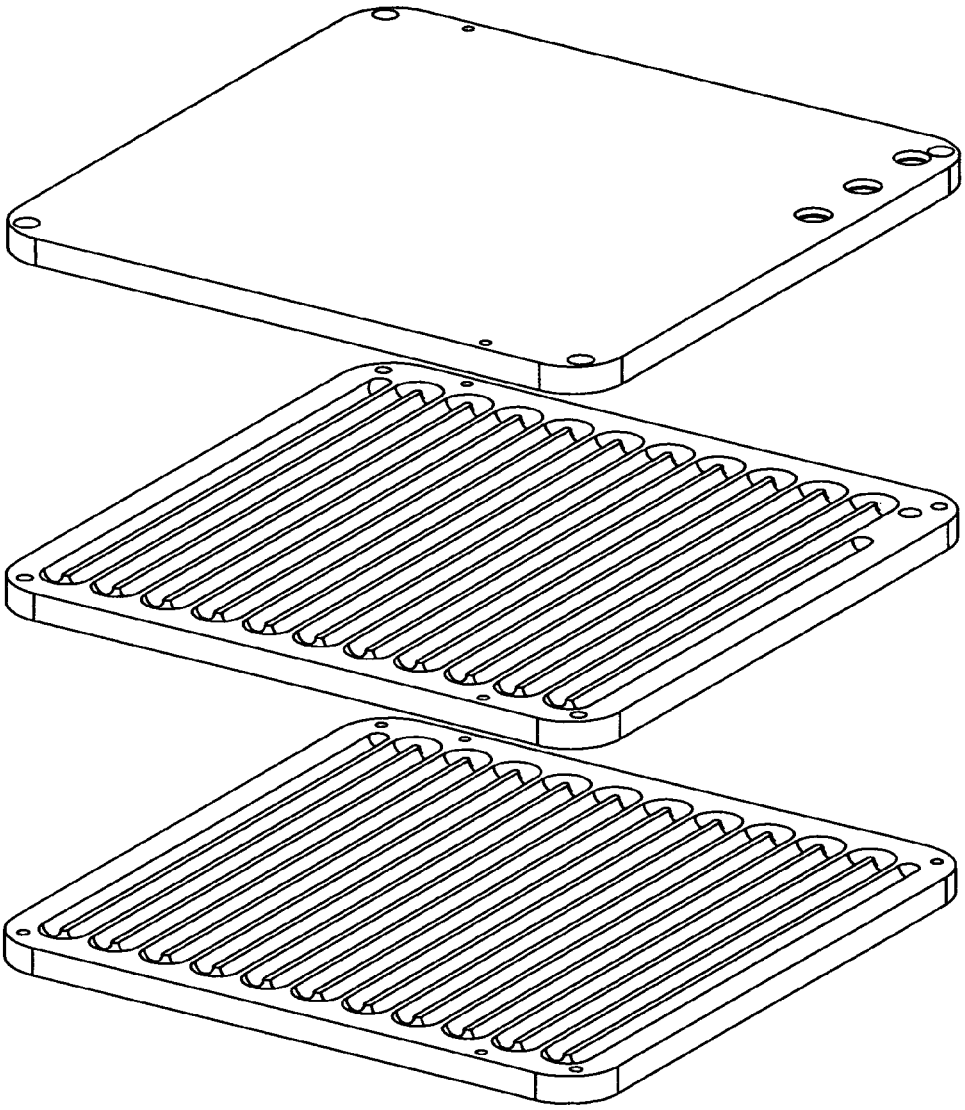
FIG. 4 is a perspective exploded view of another embodiment of the conditioning vessel.

Referring now to FIG. 3, the conditioning vessel of the invention is shown in exploded view. A housing 20 is comprised of three metal plates. A top plate 7 receives inlet port 5 containing the fuel, carbon dioxide port 24, and outlet port 27 containing the stream of conditioned fuel after traveling 28 feet through a tubular passage that allows time for the fuel to dissolve the gas. A middle plate 11 has a spiral channel 28 on the visible upper surface. A corresponding spiral channel on the underside of the upper plate (not visible) will form a complete tubular passage in combination with spiral channel 28 that is circular in cross section when the top plate is fixed by brazing on the middle plate. Passage 30 in the top plate connects port 5 to outer end of spiral 28. Passage 35 in top plate connects carbon dioxide inlet 24 to spiral 28. An aperture in middle plate 11 connects inner end of upper spiral to inner end of lower spiral. Apertures in upper and middle plates connect outer end of spiral 29 to the outlet port 27. The fluid entering port 5 enters the upper tube at the outer end of the upper spiral, travels to an aperture at the inner end of the spiral, passes through that aperture to the inner end of the lower spiral, travels to the outer end of the lower spiral, and from there up aperture 32 to outlet 27. The plates may be made of metal such as aluminum, and mat be brazed together by means well known in the art to form a leak free elongate tube. They may be cooled and vibrated to enhance dissolution of the gas. As shown in FIGS. 3 and 4, the elongate path of at least ten feet for the gas/fuel mixture to take from inlet portion to outlet may be of a serpentine configuration to thereby occupy less space in a housing 20 having dimensions less than eighteen inches A method of conditioning fuel and supplying conditioned fuel to a combustion process comprises: providing an elongate tubular conditioning vessel within a compact housing; a fuel inlet at a first end of the vessel for supplying fuel to a combustion process; a carbon dioxide inlet at the first end for adding carbon dioxide to the fuel; a flow meter adapted to measure flow of fuel through the vessel; a valve controlling dispensing of carbon dioxide to the carbon dioxide inlet, the valve dispensing in proportion to fuel flow as measured by the flow meter; a conditioned fuel outlet fluidly connected at a second end of the vessel for supplying conditioned fuel to a combustion process; the elongate tubular vessel having a length of at least ten feet; and the housing containing the vessel in a convoluted configuration having dimensions of less than eighteen inches.

What is claimed is:

1. A fuel conditioning and combustion chamber feeding system for an internal combustion engine, comprising: a fuel conditioning vessel, a fuel inlet for dispensing fuel into the fuel conditioning vessel, and at least one carbon dioxide inlet port for feeding liquid carbon dioxide into the fuel conditioning vessel; a liquid carbon dioxide source in a siphon tube tank; a carbon dioxide line fluidically connecting an outlet port of the carbon dioxide source with the carbon dioxide inlet port in the fuel conditioning vessel; a low-pressure fuel pump fluidically connected between a fuel source and the fuel conditioning vessel for providing fuel as required to maintain a supply of fuel as consumed by the engine and for forming a carbon dioxide in liquid fuel solution; a high-pressure fuel pump for raising pressure to a high level $P_3$ exceeding a pressure $P_4$ present in the combustion chamber of the internal combustion engine at the moment of injection and a liquid/carbon dioxide fuel solution supply line fluidically connecting an outlet port of said fuel conditioning vessel to an inlet port of said high-pressure fuel pump; a fuel supply system for feeding conditioned fuel in the form of the liquid/carbon dioxide fuel solution from said high pressure fuel pump to fuel injectors for injection at a pressure $P_3$ exceeding a pressure $P_4$ present in a combustion chamber of the internal combustion engine at a moment of injection; a flow meter adapted for measuring fuel consumption; a valve adapted to regulate the amount of carbon dioxide admitted to the conditioning vessel, the valve being controlled by the flow meter; and in which the conditioning vessel includes a passage that is at least ten feet in length, the fuel conditioning vessel having dimensions of less than eighteen inches.

2. The system according to claim 1, in which the passage in the fuel conditioning vessel has a spiral configuration.

3. The system according to claim 1, in which the passage in the fuel conditioning vessel has a serpentine configuration.

4. The system according to claim 1, wherein the fuel supply system comprises a unit injector fuel supply system for feeding conditioned fuel from the fuel conditioning vessel to fuel injectors at a pressure $P_3$ exceeding a pressure $P_4$ present in a combustion chamber of the internal combustion engine at a moment of injection.

5. The system according to claim 1, wherein the fuel supply system comprises a common rail fuel injection system, and a high-pressure fuel pump for raising a pressure of the liquid/gas fuel solution to a pressure $P_3$ exceeding a pressure $P_4$ present in a combustion chamber of the internal combustion engine at the moment of injection and for supplying the liquid/gas fuel solution to the common rail fuel injection system, a plurality of fuel injectors for injecting the liquid/gas fuel solution at the pressure $P_3$ into the combustion chamber, and a plurality of high-pressure liquid/gas fuel solution supply lines fluidically connecting multiple outlet ports of the common rail to inlet ports of the fuel injectors.

6. A fuel conditioning and combustion chamber feeding system for an internal combustion engine, comprising: a fuel conditioning vessel, a fuel inlet for dispensing fuel into the fuel conditioning vessel, and at least one carbon dioxide inlet port for feeding carbon dioxide into the fuel conditioning vessel; a liquid carbon dioxide source in a siphon tube tank; a carbon dioxide line fluidically connecting a liquid outlet port of the carbon dioxide source with the carbon dioxide inlet port in the fuel conditioning vessel; a low-pressure fuel pump fluidically connected between a fuel source and the fuel conditioning vessel for providing fuel as required to maintain a supply of fuel as consumed by the engine and for forming a carbon dioxide in liquid fuel solution; a high-pressure fuel pump for raising pressure to a high level $P_3$ exceeding a pressure $P_4$ present in the combustion chamber of the internal combustion engine at the moment of injection and a liquid/carbon dioxide fuel solution supply line fluidically connecting an outlet port of said fuel conditioning vessel to an inlet port of said high-pressure fuel pump; a fuel supply system for feeding conditioned fuel in the form of the liquid/carbon dioxide fuel solution from said high pressure fuel pump to fuel injectors for injection at a pressure $P_3$ exceeding a pressure $P_4$ present in a combustion chamber of the internal combustion engine at a moment of injection; a flow meter adapted for measuring fuel consumption; a valve adapted to regulate the amount of carbon dioxide admitted to the conditioning vessel, the valve being controlled by the flow meter; and wherein the conditioning vessel includes a passage that is at least ten feet in length.

7. The system according to claim 6, in which the passage in the fuel conditioning vessel has a spiral configuration.

8. The system according to claim 6, in which the passage in the fuel conditioning vessel has a serpentine configuration.

9. The system according to claim 6, wherein the fuel supply system comprises a unit injector fuel supply system for feeding conditioned fuel from the fuel conditioning vessel to fuel injectors at a pressure $P_3$ exceeding a pressure $P_4$ present in a combustion chamber of the internal combustion engine at a moment of injection.

10. The system according to claim 6, wherein the fuel supply system comprises a common rail fuel injection system, and a high-pressure fuel pump for raising a pressure of the liquid/gas fuel solution to a pressure $P_3$ exceeding a pressure $P_4$ present in a combustion chamber of the internal combustion engine at the moment of injection and for supplying the liquid/gas fuel solution to the common rail fuel injection system, a plurality of fuel injectors for injecting the liquid/gas fuel solution at the pressure $P_3$ into the combustion chamber, and a plurality of high-pressure liquid/gas fuel solution supply lines fluidically connecting multiple outlet ports of the common rail to inlet ports of the fuel injectors.

11. A method of conditioning fuel and supplying conditioned fuel to a combustion process, the method comprising:

providing an elongate tubular conditioning vessel within a compact housing; a fuel inlet at a first end of the vessel for supplying fuel to a combustion process; a carbon dioxide inlet at the first end for adding liquid carbon dioxide to the fuel; a flow meter adapted to measure flow of fuel through the vessel; a valve controlling dispensing of carbon dioxide to the carbon dioxide inlet, the valve dispensing in proportion to fuel flow as measured by the flow meter; a conditioned fuel outlet fluidly connected at a second end of the vessel for supplying conditioned fuel to a combustion process; the elongate tubular vessel having a length of at least ten feet; and the housing containing the vessel in a convoluted configuration having dimensions of less than eighteen inches.

* * * * *